United States Patent [19]

Harburg

[11] Patent Number: 5,011,099

[45] Date of Patent: Apr. 30, 1991

[54] KITE WITH SELF INDUCED DIHEDRAL ADJUSTABLE KEEL AND STABILIZING SAIL TURBINES

[76] Inventor: Rudolph W. Harburg, 1020 Mapleton Ave., Boulder, Colo. 80302

[21] Appl. No.: 404,092

[22] Filed: Sep. 7, 1989

[51] Int. Cl.[5] ..... B64C 31/06

[52] U.S. Cl. ..... 244/153 R; 244/155 R; 244/155 A

[58] Field of Search ..... 244/153 R, 154, 155 R, 244/155 A; D21/87-89

[56] References Cited

U.S. PATENT DOCUMENTS

| | | | |
|---|---|---|---|
| 1,105,058 | 1/1914 | Bochau . | |
| 2,472,290 | 6/1949 | Fernstrum | 244/154 |
| 2,484,316 | 10/1949 | Simons . | |
| 2,518,768 | 8/1950 | Fugate | 244/153 R |
| 2,524,500 | 10/1950 | Whitehurst | 244/153 R |
| 3,055,622 | 9/1962 | Harmon | 244/153 R |
| 3,074,672 | 1/1963 | Hanrahan, Jr. | 244/153 R |
| 3,295,793 | 1/1967 | Renart | 244/153 R |
| 3,347,500 | 3/1967 | Hartig | 244/154 |
| 3,582,025 | 6/1971 | Richardson . | |
| 3,954,235 | 5/1976 | Powell | 244/153 |
| 4,103,850 | 8/1978 | Bushell | 244/153 |
| 4,251,040 | 2/1981 | Loyd | 244/154 |
| 4,272,044 | 6/1981 | Cooper | 244/153 |
| 4,286,762 | 9/1981 | Prouty | 244/153 |
| 4,685,642 | 8/1983 | Schloss . | |
| 4,742,977 | 5/1988 | Hellwege | 244/123 |
| 4,815,681 | 3/1989 | Crowell | 244/153 R |

FOREIGN PATENT DOCUMENTS

| | | | |
|---|---|---|---|
| 344275 | 3/1931 | United Kingdom | 244/154 |

*Primary Examiner*—Galen Barefoot

[57] ABSTRACT

A versatile kite having three unique features: a dihedral and double parabolic camber provided entirely by the geometry and interaction between its two spars and its flight skin, a keel that may be adjusted from zero to several inches using a simple wing nut to create a fold in the kites flight skin, and the use of light weight wind responsive sail turbines attached to the wing tips of the kite to create excellent balance and control, provide an aerial display.

15 Claims, 9 Drawing Sheets

KITE WITH SELF INDUCED DIHEDRAL ADJUSTABLE KEEL AND STABILIZING SAIL TURBINES

BACKGROUND OF THE INVENTION

Innovation in kites has been going on for hundreds of years. The present invention pertains to combining three unique features in one kite. The first feature is an improved construct for inducing a dihedral and a double parabolic camber in a diamond shaped kite. The closest prior art is described in U.S. Pat. No. 4,742,977, which is a Wing Structure With Self Induced Camber requiring three structural members, two lateral brace members along the two leading edges of the kite and a spine down the center. The present invention requires only two structural members, a spine down the center and one wing spar, thus providing an improved weight to wing span ratio. Further, the prior art example requires that spars be attached along the leading edge. This construction precludes advantages such as being able to use the leading edges of the flight skin to form an adjustable keel fold. Other dihedral kites are well known, but the present invention uses the geometry of the two structural members and the flight skin to achieve both a dihedral and a double parabolic camber thus avoiding elements such as a bow string which tends to complicate and limit such possibilities as attaching rotors to the leeward side of the kite. This new self induced double parabolic kite combines the lift and stability advantages of a delta type kite with the structural efficiency and weight efficiency advantages of the two stick diamond kite.

The second unique feature is the adjustable keel. Adjustable keel are known in prior art. The best examples are U.S. Pat. Nos. 4,272,044 and 3,347,500. Prior art, pertaining to adjustable keels, falls into two categories: (1) kites that require additional primary elements such as flexible sheets and structural members and (2) kites with keels that have a plurality of holes providing alternative tethering positions. The present invention is an improved, simpler and more elegant solution to the adjustable keel problem requiring a single fastener such as a thumb screw and utilizing the flight cloth and the geometry of the kite itself. Fixed keels made by sewing folds into the flight skin of the kite are well known in prior art. Examples of this are U.S. Pat. No. 1,105,058 by W. A. Bochau, U.S. Pat. No. 2,484,316 by S. C. Simons and U.S. Pat. No. 4,103,850 Helen Bushell. However, none of these keels have the physical feature of being readily adjustable. With these prior art keels, one might adjust the wing span, the keel depth and flight characteristics of the kite, but this would require ripping out the stiching and sewing another keel seam. This new seam could make the keel depth greater and the wing span shorter, or visa versa. But obviously, these prior art keels were not designed to be adjustable in the field, or otherwise. This invention makes it possible to quickly and easily adjust the keel depth, the degree of dihedral and the flight characteristics of the kite. This invention virtually assures the pilot of success regardless of experience level, or wind conditions. This is a significant improvement over prior art.

The third unique feature of the kite is the use of light weight wind responsive sail turbines attached to opposing wing tips to stabilize and control the kites aerodynamic performance, and to provide an aerial display. Single rotor kites and multi rotor kites are in the prior art, the closest examples of which are U.S. Pat. No. 3,582,025 a multi rotor kite and U.S. Pat. No. 4,685,642 a single rotor kite. The present invention differs from and is a substantial improvement over prior art multi rotor kites, differing from the prior art in both rotor orientation and construction. Unlike prior helicopter type rotors, the present invention uses light weight sail turbines rotating normal to the direction of the wind to provide an aerial display for ground observation, to amplify the dihedral in the host kite at the precise instance when it is mosted needed, and to provide a means for control and stabilization of the entire flight system.

DEFINITION OF TERMS USED IN SPECIFICATIONS AND CLAIMS

FLIGHT SKIN—The flexible covering of plastic film, cloth, paper or the like stretched across the kite or turbine frame to provide an airfoil surface.

CORNERS—Points of geometric intersection of the peripheral edges of the flight skin (as in the corner of a triangle) where said points of geometric intersection are directly attached to an element of the kite or turbine frame, typically the end point of a spar or spoke.

BALANCED FLIGHT—The position a kite assumes in flight elevated in the wind when the forces on it are balanced and the kite is stable.

WINDWARD SIDE—In balanced flight, the side of a kite predominantly facing the direction from which the wind is blowing.

LEEWARD SIDE—In blanced flight, the side of the kite predominantly facing the direction towards which the wind is blowing.

TOP CORNER—The highest corner of a kite's flight skin during balanced flight.

BOTTOM CORNER—The lowest corner of a kite's flight skin during balanced flight.

RIGHT CORNER—In balanced flight, the right most corner of the kite's flight skin on its windward side.

LEFT CORNER—In balanced flight, the left most corner of the kite's flight skin on its windward side.

HORIZONTAL—Horizontal with respect to balanced flight.

VERTICAL—Vertical, predominantly vertical, or having some angle of incline from the horizontal with respect to balanced flight.

SPAR—A structural element which keeps the flight skin spread in the shape of an airfoil.

TOP RIGHT EDGES OF FLIGHT SKIN—The perimeter edge of the flight skin that is most elevated on the right-hand windward side of the kite.

TOP LEFT EDGE OF FLIGHT SKIN—Opposite of "top right edge of flight skin".

BOTTOM RIGHT EDGE OF FLIGHT SKIN—The perimeter edge of the flight skin that is least elevated on the right-hand, windward side of the kite in balanced flight.

BOTTOM LEFT EDGE OF FLIGHT SKIN—Opposite of bottom right edge of flight skin.

FREE EDGE—A preimeter edge of a flight skin which is attached to the kite frame only at its corners and not attached to a structural member along its length.

SPAR TIP—Either end or terminus of a spar.

RIGHT TIP—The right end point or terminus of an element with respect to the windward side and balanced flight.

LEFT TIP—The left end point or terminus of an element with respect to the windward side and balanced flight.

HUB—A connection point for attaching a turbine.

SPOKE POCKET—A hem having an opening at one end and having a closure at the other end so that a spoke can slide into the pocket through the opening but be stopped from going any deeper into the pocket by the closure.

SPECIFICATIONS FOR IMPLEMENTING THE INVENTION

Figure 1:
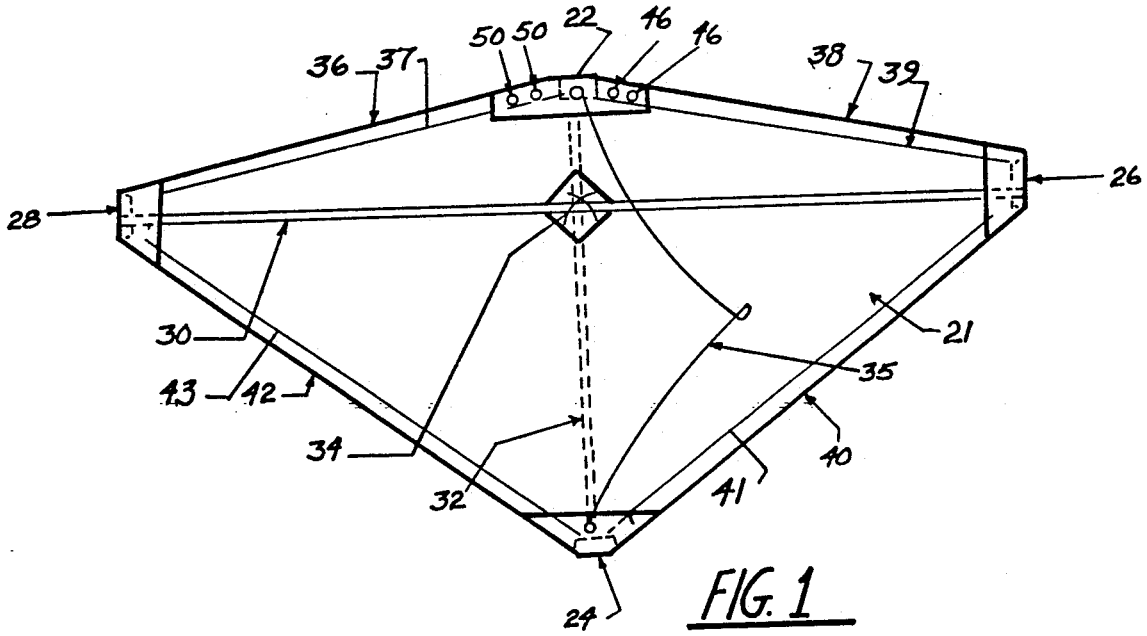
FIG. 1. is a plan view of the diamond shaped kite capable of self induced dihedral with double parabolic camber airfoils.
Figure 2:
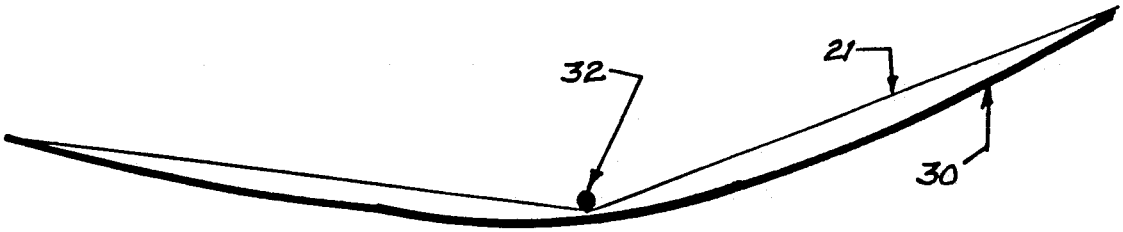
FIG. 2 is a sectional view of the kite of FIG. 1 under no wind load.
Figure 3:
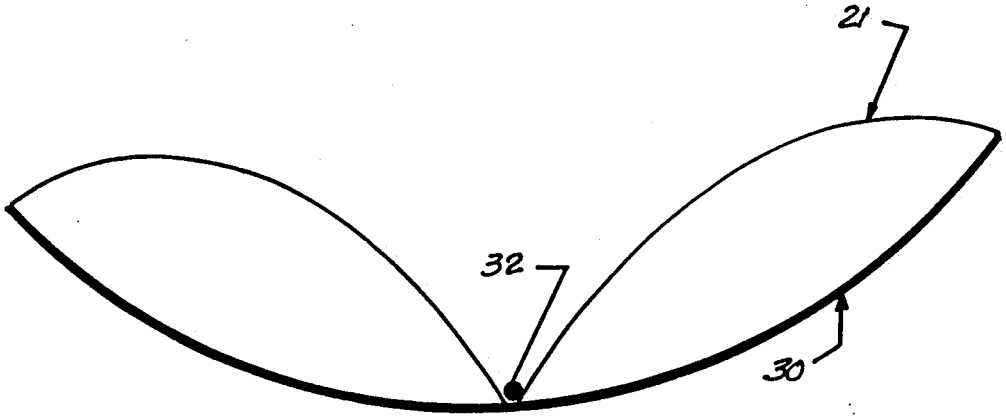
FIG. 3 is a prespective view of the kite of FIG. 1, under wind load.

FIG. 1 shows the windward side of the two stick double parabolic camber kite invention 20 comprising a diamond shaped flexible flight skin 21, having a top corner 22, a bottom corner 24, a right corner 26, and a left corner 28. This flight skin is stretched over a kite frame comprising a horizontal wing spar 30 attached to the right and left corners on the windward side of the flight skin and a vertical spar 32 attached to the top and bottom corners on the leeward side of the flight skin. The horizontal spar is deliberately longer than the distance between its two points of attachment. Upon assembly, the resulting tension in the flight skin causes the horizontal spar to bow into a dihedral. FIG. 2 shows a cross section of said wind responsive kite under no wind load. FIG. 3 shows the cross section of the same kite under substantial wind load illustrating the double parabolic camber of the flight skin characteristic of this invention in a substantial wind load situation.

If wing spar 30 is chosen to have sufficient flexibility then the initial dihedral can be zero. In this case the dihedral is provided by wind pressure as shown by FIG. 2 and FIG. 3 in combination.

FIG. 1 also shows light attachment means 34, in this case, two loops of string sewn through the flight skin and looped around the wing spar and around the vertical spar to additionally stabilize the vertical positioning on the center of the wing spar.

An 80 inch long, 0.32 inch diameter hollow fiberglass wing spar will take on a 15 degree dihedral when it is approximately two and a half percent longer than the distance between its attachment points on a rip stop nylon flight skin. The degree of dihedral can be increased by increasing the spar length or decreased by decreasing the spar length depending on design objectives. Design objectives may require a dihedral ranging from two degrees to forty degrees. Many factors effect the selection of dihedral. A stunt kite example of this selection is as follows: A kite having a horizontal wing spar twice as long as its vertical spar and having an initial dihedral of fifteen degrees can be flown as a spirited one or two string stunter.

Again referencing FIG. 1 there are four edges on the flight skin: top right edge 38, top left edge 36, bottom right edge 40, bottom left edge 42. These edges sustain substantial tinsel strength in flight. One efficient way to provide for this requirement is to reinforce the edges with guy means, 37, 39, 41 and 43 consisting of material such as filament tape, flight skin hems, or a combination thereof.

Figure 4:
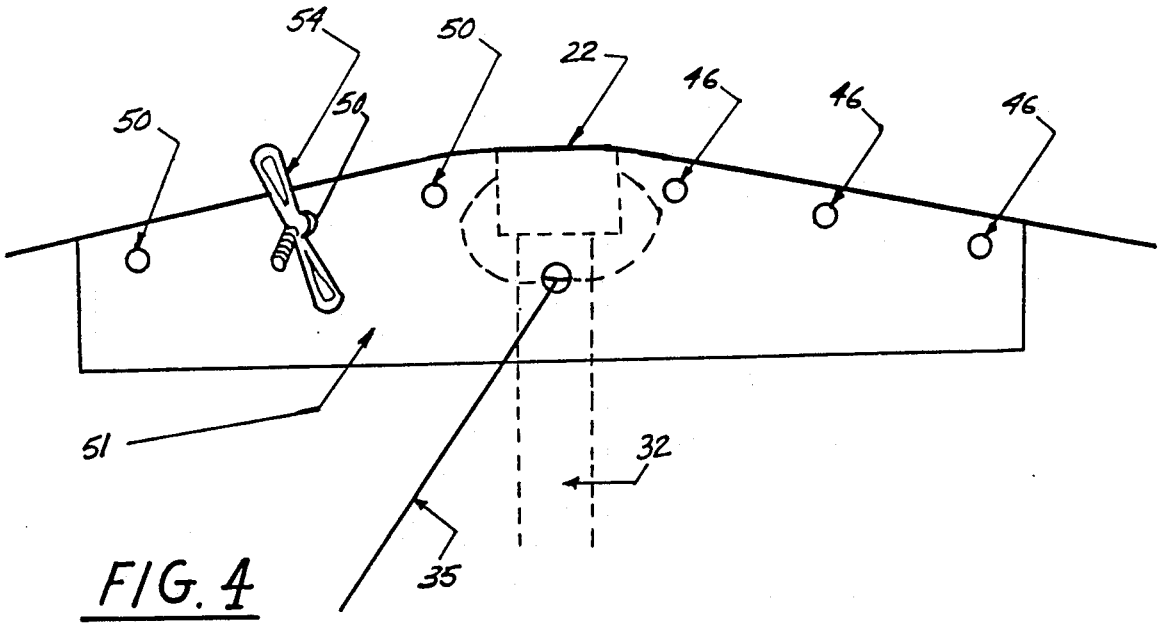
FIG. 4 is a detail of an adjustable keel rigged flat.

FIG. 4 illustrates the adjustable keel invention that can be incorporated as part of the two stick double parabolic kite of FIG. 1, or can be readily adapted to any kite having a top corner with a top right edge and a top left edge emanating therefrom, or having any corner with two perimeter edges of the flight skin emanating therefrom. This adjustable keel invention comprises a wing nut and thumb screw of matching thread 54, or the equivalent thereof, right connection points 46 consisting of holes punched and reinforced with grommets along the top right edge of the flight skin and left connection points 50 punched and reinforced with grommets along the left top edge of the flight skin. The flight skin is reinforced in this general area by reinforcement fabric 51.

Figure 5:
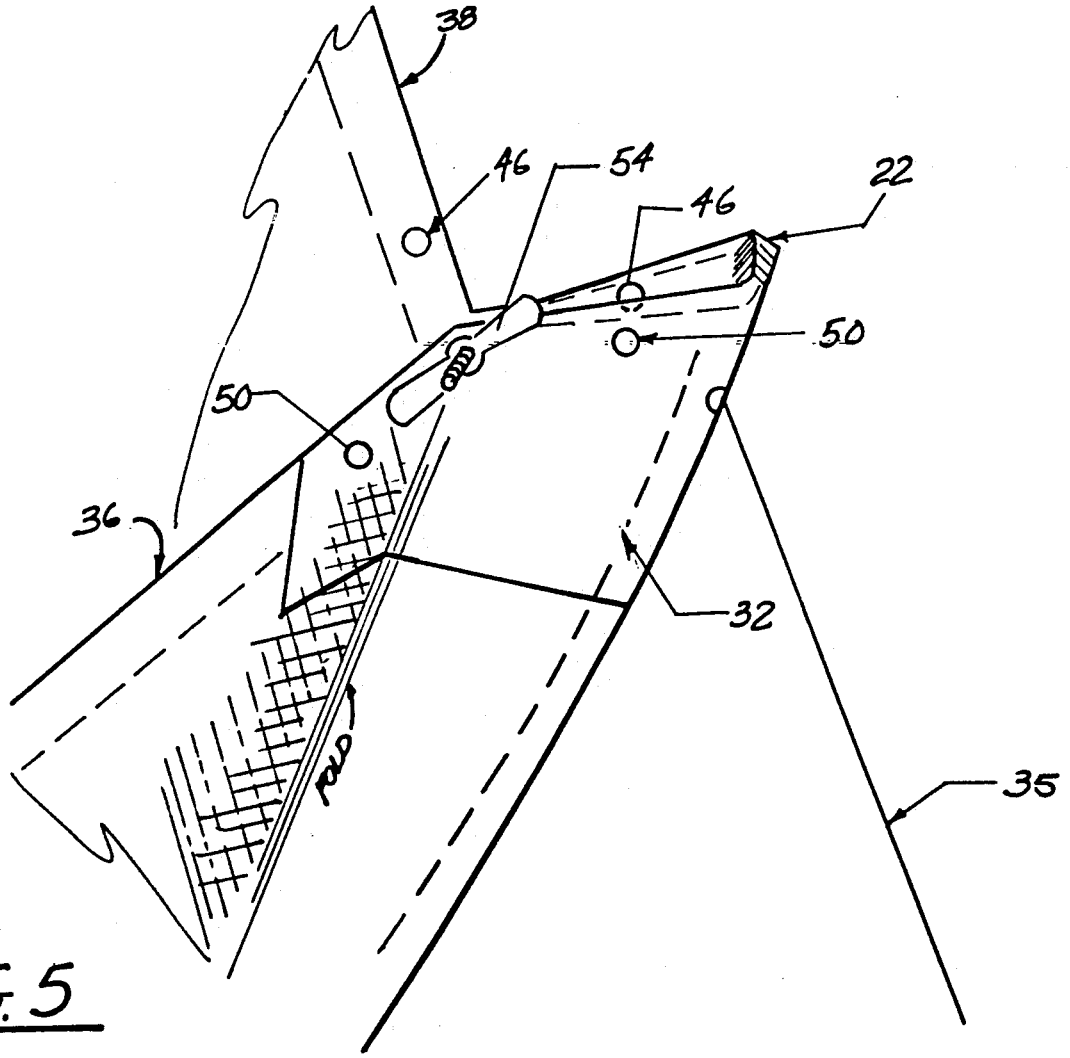
FIG. 5 is a detail of an adjustable keel in the two thirds keel position.

FIG. 5 shows one of the right grommet holes 46 held against one of the left grommet holes 50 by inserting a thumb screw through both holes and securing this thumb screw with a wing nut 54. Note that the holes have been pulled together on the leeward side of the vertical spar 32. FIG. 5 and FIG. 1 in combination show the right top edge of the flight skin 38 and the left top edge of the flight skin 36 and are held in tension between the fastening means 54 at the point of connection and the tips of the wing spar 30 where said wing spar attaches to the flight skin at right corner 26 and left corner 28. The keel is held in tension between the fastening means 54 and vertical spar 32. The right connection point 46 and the left connection point 50 are typically chosen to be equidistant from the top corner 22 to achieve symmetry.

FIG. 16 shows an alternative fastening means for affecting an adjustable keel where track 55 in implanted along top edges 36 and 28 and slider 53 is disposed to hold together opposing connection points on edge 36 and 38 causing a keel. Slider 53 could be moved manually or by mechanical means known in the prior art of moving sliders.

Figure 6:
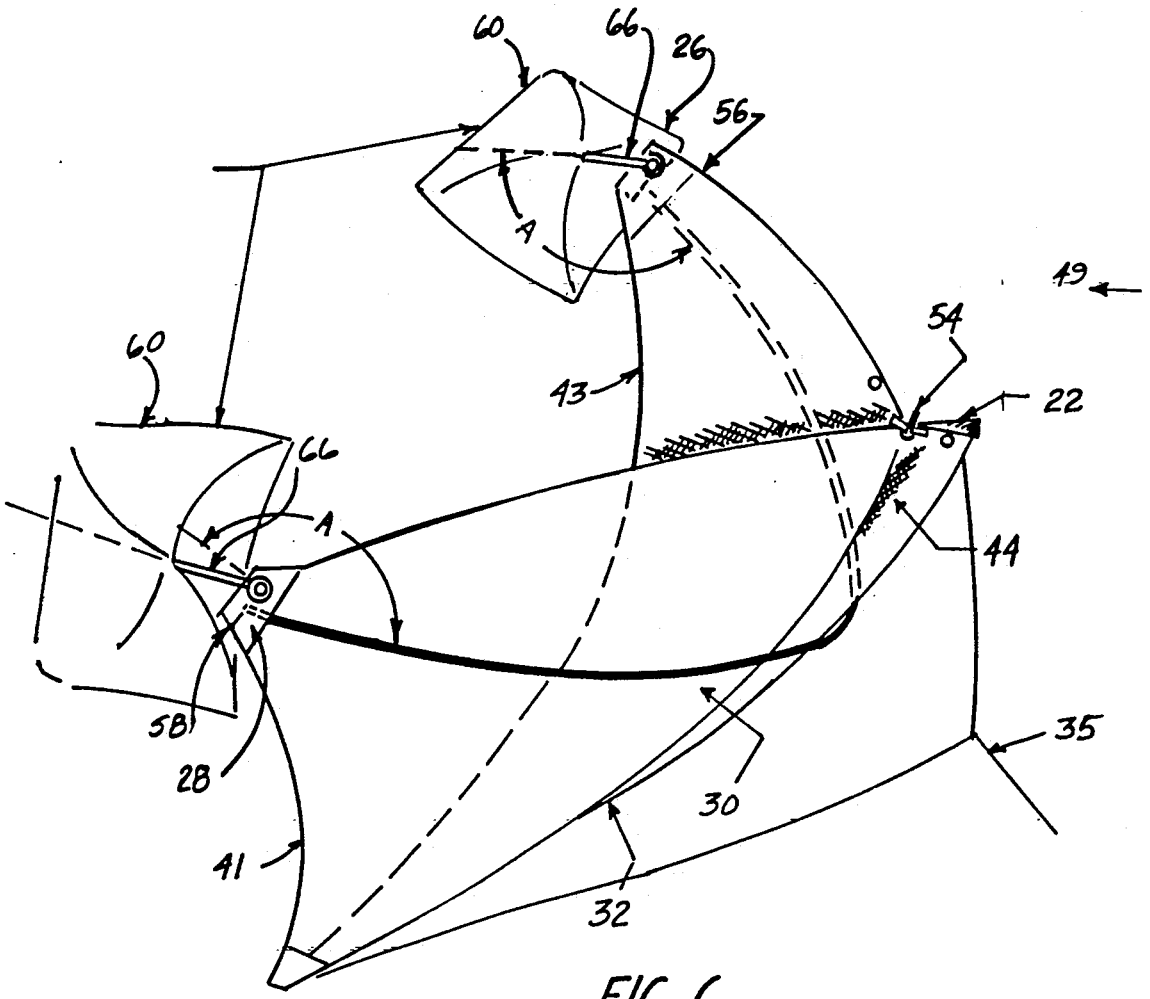
FIG. 6. is a prespective view of the kite of FIG. 1 flown with an adjustable keel and with light weight wind responsive sail turbine attached to both wing tips.

FIG. 6, is, in part, a prespective of the two stick double parabolic cambered kite, invention 20, incorporating the keel invention 44, shown therein as a top keel in tension between the top corner 22 and fastening means 54. Note that in like manner a bottom keel might have been incorporated therewith by clamping together connection points on bottom edges 41 and 23. Note also that in general the choice of depth of keel is both a design decision as it relates to where the grommeted holes are located, and an operator decision as it relates to the choice of which pair of trommeted holes will be used to form the keel. In general as keel depth decreases, lift increases and also flight skill required increases. The unique advantage of the adjustable keel is that the novice operator can start with a deep keel and work towards flying with no keel at all, thereby avoiding the discouragement of the initial failure experience all too often associated with stunt kiting. FIG. 16 illustrates the use of tracks incorporated in the two peripheral edges of a flexible flight skin emanating from corner 22 and thereby establish a way to slide a fastening means referred to now herein as a slider or zipper along there two peripheral edges.

Figure 7:
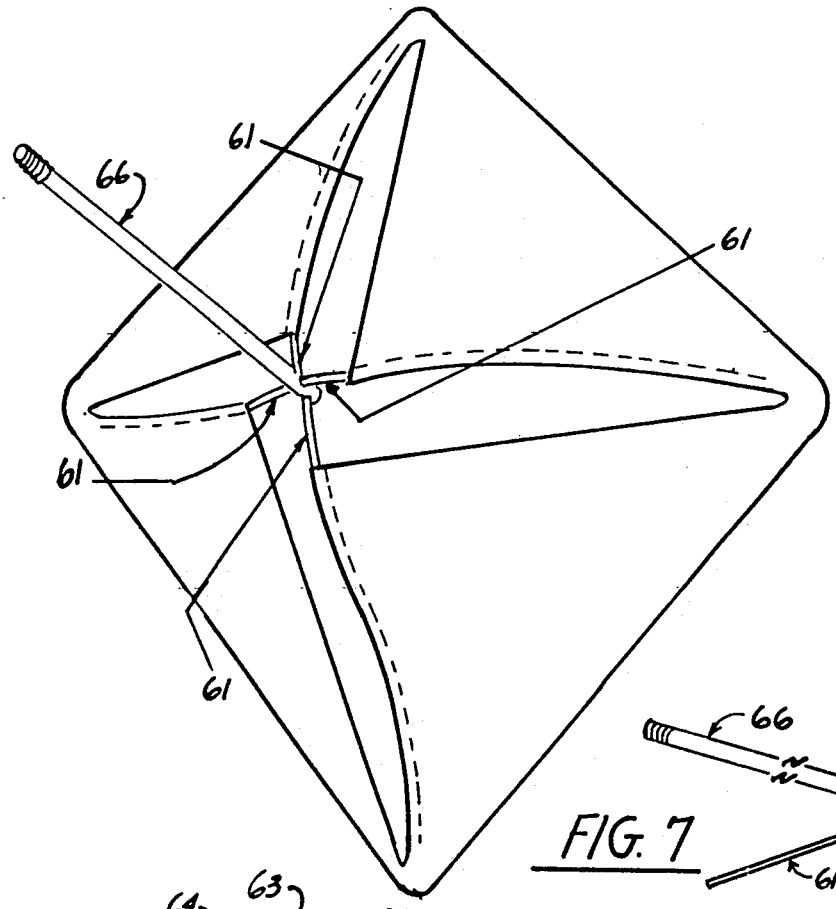
FIG. 7 is a prespective view of light weight wind responsive sail turbine.
Figure 8:
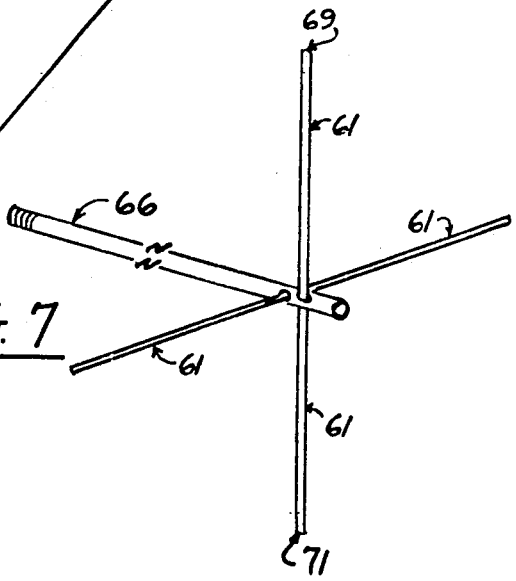
FIG. 8 is a prespective view of a sail turbine frame.

FIG. 7 is a perspective of a light weight wind activated sail turbine which can be attached to a host kit comprising an axle rod 66, a plurality of spokes 61 passing through and emanating from the axle rod 66 to make the turbine frame of FIG. 8.

Figure 9:
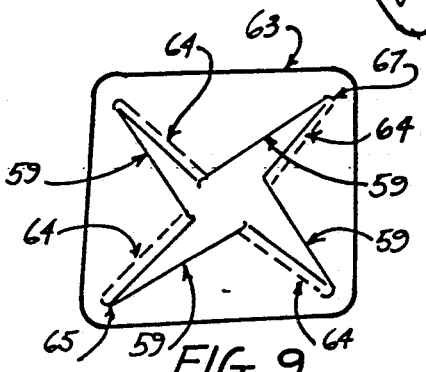
FIG. 9 is a plan view of the sail turbine flight skin.

FIG. 9 shows the unattached flight skin 63 which has a plurality of spoke pockets 64 where each spoke on the frame is slipped into a spoke pocket in the flight skin. The unstressed distance between the opposite corners 65 and 67 of the flight skin in FIG. 9 is less than the length of opposite ends of the spokes inserted therein, tips 69 and 71 of FIG. 8. Consequently when the spokes are inserted into the spoke pockets on the flight skin, the spokes deformed into S shaped dihedrals. Even in a no wind load condition the sides of the slits 59 supported by spokes protrude significantly windward of the sides of the slits 59 not supported by spokes. Thus the tension interaction between the turbine frame and the flight cloth creat a well supported, extremely light weight, fan turbine. If sufficiently flexible material is chosen for the spokes the wind pressure will cause the sail turbine to deflect into a dihedral. This option allows for the sail turbines to be constructed with the spoke pockets being substantially the same length as the spokes that fit therein. Extra flexible fiberglass rod is a useful material for this application.

FIG. 6 shows, in part, the two stick double parabolic cambered kite invention 20 with light weight sail turbines attached to both tips of the wing spar 30 at corners 26 and 28. Wind direction is indicated by arrow 49. The axle rods 66 are free to turn and slide in hubs 56 and 58 attached to the wing spar at corners 26 and 28.

Figure 10:
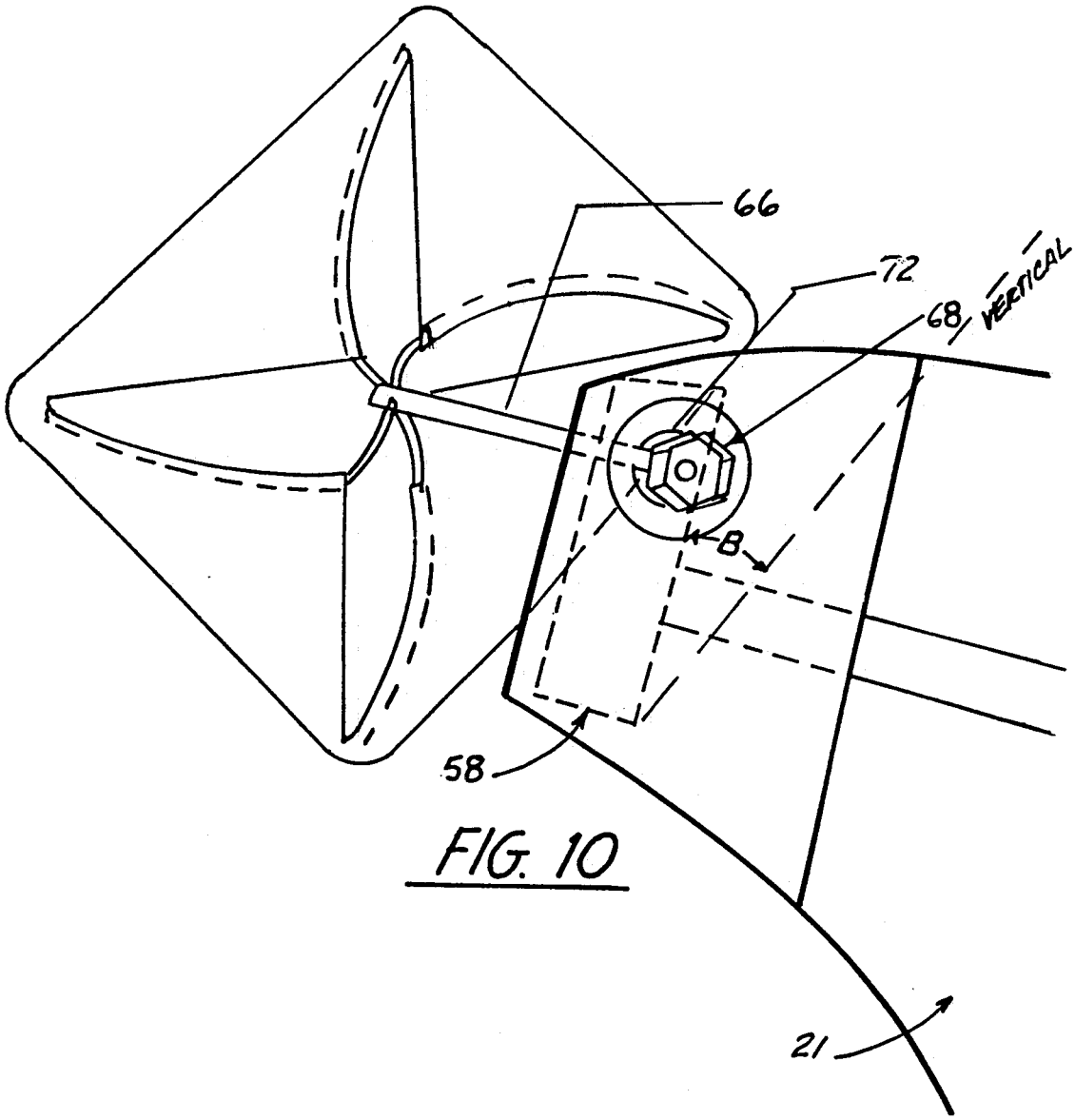
FIG. 10 is a detail of a rigid attachment means for connecting the sail turbine to the wing tip.

FIG. 10 details the light weight turbine attachment. In balanced flight wind pressure on the turbine causes the axle rods 66 to slide through the drilled holes 72 until the keeper nut 68 bears on hub 58 whereupon the turbine rotates, the leeward side of the keeper nut 68 and the windward side of hub 58 forms the bearing surface.

Figure 11:
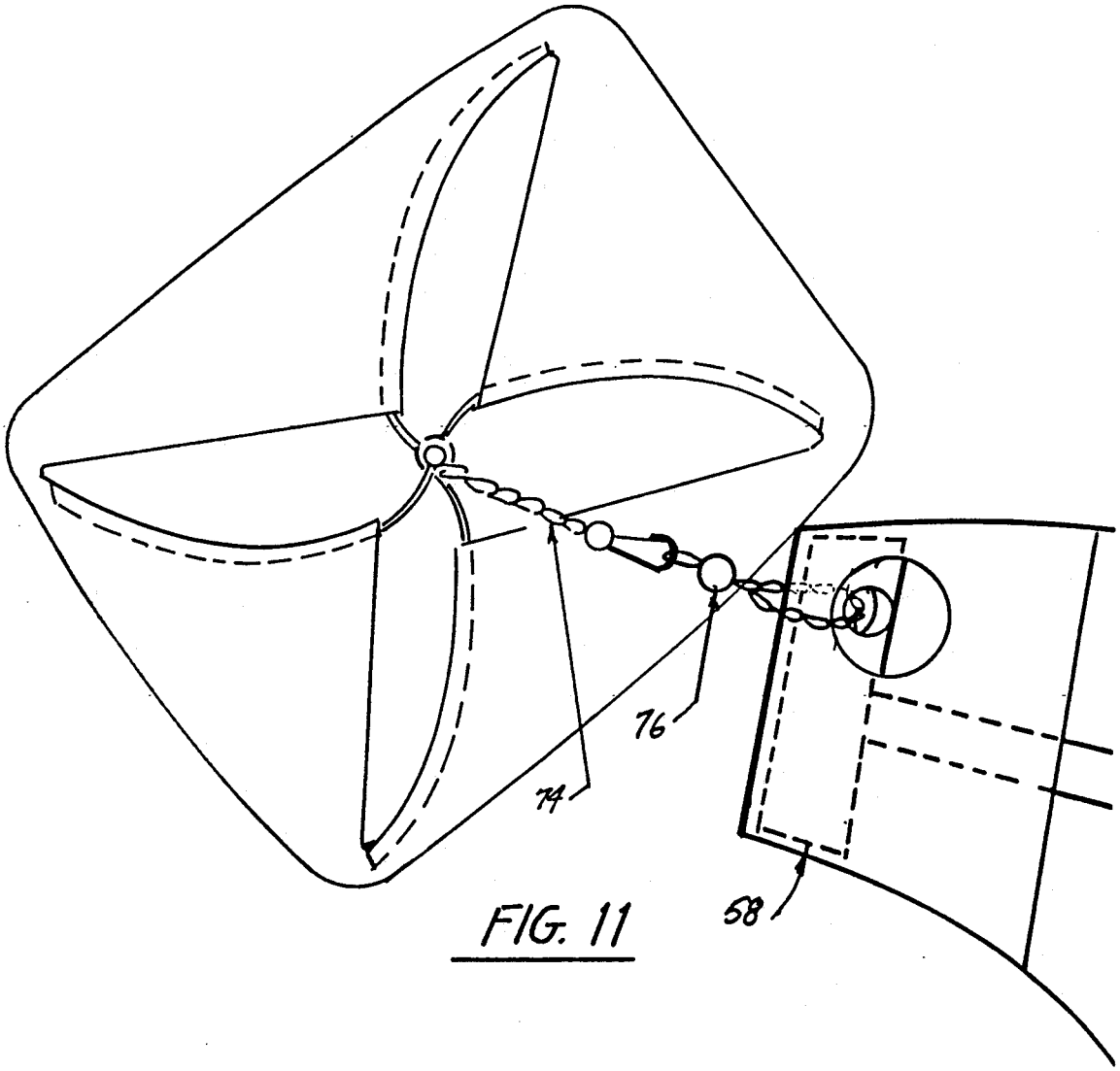
FIG. 11 is a detail of a flexible attachment means for connecting the sail turbine to the wing tip.
Figure 12:
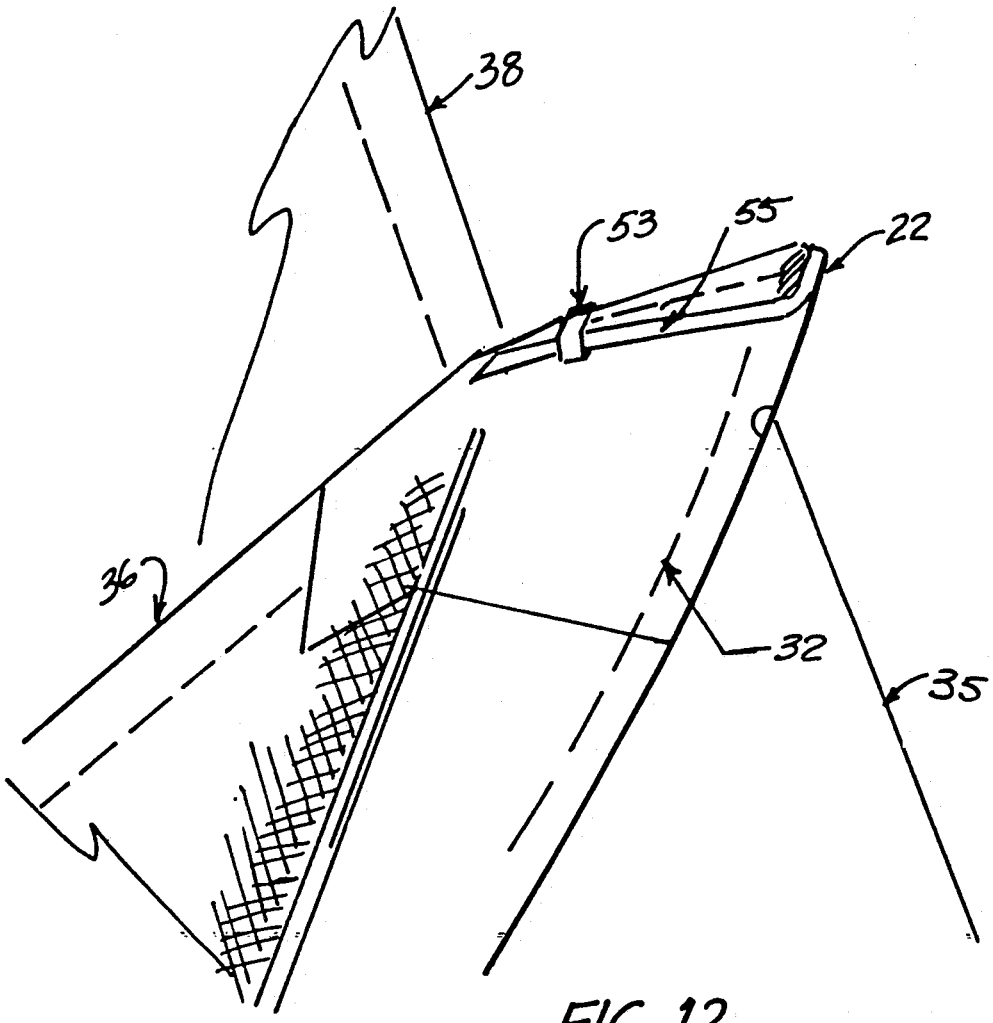
FIG. 12 is a prespective detail of the use of a slider and a triangular rack attached to a kite to facilitate an adjustable keel.

FIG. 11 shows how the axle rod may be of flexible means 74 having a pivot 76 that allows the turbine to rotate relative to hub 58. In the case of solid axle 66 of FIG. 10, the hole in the hub 58 is typically oriented with respect to the flight system in balanced flight so that the turbines trail on the leeward side of the flight skin of the host kite 21 and rotate normal to the direction of the wind. This can be accomplished by over sizing the hole 72 relative to the axle rod 66 to provide slack, by tilting the hub to compensate for the kites angle of attack so as an example the hub makes an angle B in FIG. 10 of 30 degrees within the vertical, and by drilling the holes so the angle A in FIG. 6 between the axis of the hole and the axis of the wing spar is approximately one hundred and fifteen degrees. This angle of 115 degrees (more or less) allows the turbine to rotate normal to the wind when the dihedral increases under wind load. In this position turbines provide a more complete aerial display and in addition they greatly stabilize the host kite, partly by pressing against the wing spar and increasing the dihedral at the precise instant that increased dihedral is needed i.e. when a gust hits the kite, and partly because they provide a drag on both tips of the wing spar that act like the weights on the end of a bar carried by a tight rope walker. This use of counter opposing turbines facilitates flight stability heretofore unknown in the art of kites. In addition the use of sail turbines enables the kite to have a much greater aspect (width to vertical height) which greatly improves lift.

FIG. 6 in its totality shows the two stick double parabolic camber kite invention 20, the adjustable keel invention 44, and the use of light weight sail turbines 60 for aerial display and improved aerodynamic flight characteristics.

CONCLUSION

The three unique aspects of this kite invention; self induced dihedral with double parabolic camber, adjustable keel, and sail turbine provide the widest range of kite flying experience and commercial possibilities known to date.

What is claimed is:

1. A wind responsive kite comprising in combination: a diamond shaped flexible flight skin having four corners, a top corner, a bottom corner, a right corner and a left corner; a horizontal wing spar which attaches to the flight skin at its right and left corners where the horizontal wing spar is positioned on the windward side of the flight skin, and where the horizontal wing spar is longer than the distance measured along the flight skin between the two points of attachment at its aforementioned right and left corners causing the horizontal wing spar to bow into an initial dihedral due to the tension in the flight skin; and a vertical spar which attaches to the flight skin at its top and bottom corners where the vertical spar is positioned on the leeward side of the flight skin.

2. The kite of claim 1 wherein the horizontal wing spar is positionally stabilized by light attachment means that secure its center point to the flight skin.

3. The kite of claim 1 wherein the initial dihedral is between 2 and 40 degrees.

4. The kite of claim 1 wherein four guy means are incorporated into the four perimeter edges of the flight skin one guy being stretched between each adjacent pair of the four corners of the flight skin.

5. The kite of claim 1, having a right peripheral edge with a plurality of right connection points and an opposing left peripheral edge with a plurality of left connection points, both peripheral edges eminating from a common corner, where the moveable fastening means holds a right connection point to an opposing left connection point, and where said movable fastening means causes the right and left connection points to be drawn and held together on the leeward side of the corner thereby producing a keel in the flight skin.

6. The kite of claim 5 having a multiplicity of said connection points and a multiplicity of said left connection points spaced along the right and left top edges of the flight skin, whereby the keel is made adjustable as to depth by way of selection of which one of said right connection points and which one of said left connection points are held together by the moveable fastening means.

7. The kite of claim 6 wherein the multiplicity of connection points are holes formed near both the right and the left top edges of the flight skin, and where the moveable fastening means is a threaded fastener means.

8. The kite of claim 6 wherein the fastening means is a zipper clamp that can be readily loosened to slid continuously from pair to pair of right and left connecting points and wherein the zipper clamp can readily be tightened to hold any selected pair of points together thereby adjusting the depth of the keel.

9. The kite of claim 5 wherein the holding action of the moveable fastening means increases the tension in the flight skin and thereby simultaneously forms the keel and increases the degree of dihedral in the horizontal wing spar as the depth of the keel is increased.

10. The kite of claim 1 wherein a wind responsive turbine is connected by attachment means to the right tip of the horizontal wing spar, and another wind responsive turbine is connected by attachment means to the left tip of said wing spar, where both said turbines trail to the leeward of the flight skin.

11. The kite of claim 5 wherein a wind responsive turbine is connected by attachment means to the right tip of the horizontal wing spar, and another wind responsive turbine is connected by attachment means to the left tip of the horizontal wing spar, and where both said turbines trail to the leeward of said flight skin.

12. An adjustable keel incorporated into a kite where said kite has a corner and where said corner has two free perimeter edges of the flight skin emanating the opposing directions right and left therefrom where both perimeter edges have a plurality of fastening points and comprising:

said kite, with its corner, perimeter edges and plurality of connection points, and a movable fastening means for holding one connection point on the right perimeter edge to an opposing connection point on the left perimeter edge, whereby this pair of connection points are drawn and held together on the leeward side of the corner to form a keel fold in the flight skin, where the depth of the keel fold is determined by the distance between said connection points and the corner, and where the depth of the keel may be readily adjusted by moving the movable fastening means to a different pair of right and left connection points on the opposing perimeter edges.

13. The keel of claim 12 wherein said connection points are holes formed in the flight skin and the fastening means is a threaded fastener means.

14. The keel of claim 12 wherein the fastening means is a zipper clamp that can be readily slid continuously from pair to pair of right and left connecting points, and wherein the zipper clamp can be readily clamped to hold any selected pair of points together thereby adjusting the depth of the keel.

15. A method for creating a keel in a kite and adjusting the depth of the keel and the geometry and flight characteristics of the kite where the kite, has a corner, where two peripheral edges of the flight skin emanate in opposing right and left directions from the corner and where both peripheral edges have a plurality of connection points, comprising the steps of:

first, using a moveable fastening means to draw and hold the two opposing edges together at connecting points, on the leeward side of the corner thereby producing a keel in the flight skin, and second, intentionally moving the fastening means to hold together different pairs of connection points along the opposing right and left peripheral edges thereby adjusting the depth of the keel.

* * * * *